US005944592A

United States Patent [19]

Hall et al.

[11] Patent Number: 5,944,592

[45] Date of Patent: Aug. 31, 1999

[54] SHARPENER APPARATUS

[75] Inventors: Jeffrey B. Hall, Clayton; William D. Parker, Raleigh, both of N.C.

[73] Assignee: Underwriters Laboratories Inc., Northbrook, Ill.

[21] Appl. No.: 08/846,956

[22] Filed: Apr. 30, 1997

Related U.S. Application Data

[63] Continuation of application No. 08/447,893, May 23, 1995, abandoned.

[51] Int. Cl.[6] ..... B24B 3/48

[52] U.S. Cl. ..... 451/321; 451/162

[58] Field of Search ..... 451/162, 321, 451/322, 323, 45, 526, 525, 524

[56] References Cited

U.S. PATENT DOCUMENTS

| | | | |
|---|---|---|---|
| 471,679 | 3/1892 | Spruce | 451/321 |
| 480,634 | 8/1892 | Spruce | 451/321 |
| 776,967 | 12/1904 | Van Tassel et al. | 451/321 |
| 805,332 | 11/1905 | Yow | 451/321 |
| 1,916,929 | 7/1933 | Lee . | |
| 1,979,741 | 11/1934 | Hangi | 451/321 |
| 2,131,626 | 9/1938 | Keith . | |
| 2,201,645 | 5/1940 | Epner | 451/524 |
| 2,237,488 | 4/1941 | Jarvi | 451/321 |
| 2,324,025 | 7/1943 | Revell . | |
| 2,391,260 | 12/1945 | Miller et al. . | |
| 2,482,344 | 9/1949 | Kent | 451/525 |
| 2,509,561 | 5/1950 | Dremel | 451/524 |
| 2,585,655 | 2/1952 | Ingram | 451/524 |
| 2,588,089 | 3/1952 | Custis et al. . | |
| 2,703,951 | 3/1955 | Smith . | |
| 2,864,206 | 12/1958 | Lane et al. . | |
| 4,217,735 | 8/1980 | McGeoch et al. | 451/321 |

OTHER PUBLICATIONS

Two pages of publication (date of issue unknown) *Woodworkers Supply*, Albuquerque, New Mexico, with three advertisements relating to beveled edge tool sharpeners encircled in yellow.

*Primary Examiner*—Timothy V. Eley
*Assistant Examiner*—Derris Holt Banks
*Attorney, Agent, or Firm*—Welsh & Katz, Ltd.

[57] ABSTRACT

A sharpener apparatus includes a base, a linear bearing assembly mounted on the base, and a support block carried by the bearing assembly for reciprocating movement along a rectilinear path relative to the base. A planar abrasive surface underlies the support block which has one or more open channels for receiving workpieces in sliding relation with the longitudinal axes of the workpiece preferably inclined to the abrasive surface. A pusher member is supported by the support block adjacent each channel for applying a constant force longitudinally of the corresponding workpiece to urge its tip against the abrasive surface. Manual or powered reciprocating movement of the support block effects an abrasive action of the workpiece tips against the abrasive surface to form a highly accurate and repeatable tip geometry, such as a chisel point, on each workpiece.

9 Claims, 1 Drawing Sheet

SHARPENER APPARATUS

This is a Continuation Application of prior application Ser. No. 08/447,893, filed May 23, 1995, now Abandoned.

BACKGROUND OF THE INVENTION

The present invention relates generally to sharpener apparatus, and more particularly to a novel sharpener apparatus which enables a precise, repeatable beveled tip geometry to be formed on a workpiece, such as an electrode, without need for a highly skilled operator.

It is often necessary in the use of specialized equipment such as test apparatus which utilizes paired electrodes for creating electric discharge arcing, to provide a precise tip configuration or geometry on each electrode to insure accurate repeatability between tests. For example, in apparatus for performing comparative tracking index tests on dielectric insulating materials so as to measure the susceptibility of insulators to electrical short circuiting across the surface of the insulator in the presence of a liquid contaminant, generally termed tracking, a pair of electrodes are utilized to create a voltage discharge arcing adjacent the surface of the test specimen. See, for example, the standardized test described in the International Electrotechnical Commission Publication 112 (IEC 112) which is incorporated herein by reference. Under the IEC 112 test, a pair of standardized electrodes are positioned on a surface of a test sample of a dielectric insulator material and an electrolyte is deposited on the dielectric material between the electrodes by a dripping process. To improve repeatability of the test described in IEC 112, the tips of the electrodes are formed with a precise planar surface inclined to the longitudinal axis of the electrode. The electrode tip geometry is preferably reformed or cleaned by sharpening before each test as necessitated by erosion from electrical arcing. Thus, a need exists for an economical sharpener apparatus which enables highly accurate and repeatable tip geometries to be formed on electrodes without requiring a highly skilled operator.

SUMMARY OF THE INVENTION

A primary object of the present invention is to provide a novel sharpener apparatus which facilitates forming of a highly accurate and repeatable tip geometry on an end of a workpiece, such as an electrode, without need for a highly skilled operator.

A more particular object of the present invention is to provide a relatively low cost sharpener which enables forming of a highly accurate and repeatable tip geometry on a workpiece by reciprocating movement of a support block having at least one open recess configured to receive the workpiece in longitudinal sliding relation, and having a pusher member operative to apply a substantially constant force on the workpiece along its longitudinal axis so as to bias the tip to be sharpened against an abrasive surface, the recess having a predetermined angular relation to the abrasive surface so as to form an accurate inclined chisel-like tip geometry on the workpiece when reciprocated against the abrasive surface.

In carrying out the invention, a sharpener apparatus is provided having a base, a linear bearing assembly mounted on the base, and a support block carried by the bearing assembly for reciprocating movement along a rectilinear path relative to the base. In the preferred embodiment, a planar surface is provided to underlie the support block and has an abrasive surface formed therein or defined by an abrasive sheet releasably supported on the planar surface.

The support block has at least one and preferably a pair of open channels or recesses formed at a predetermined angle of incline to the planar abrasive surface. Each channel is configured to receive a workpiece, such as an electrode, having a specified transverse cross-section so as to enable longitudinal sliding of the workpiece within the channel. A pusher member is supported by the support block adjacent each channel for engaging an upper end of the corresponding workpiece and applying a substantially constant force longitudinally of the workpiece to urge its tip against the abrasive surface. In this manner, reciprocating movement of the support block, either manually or by a powered drive system, effects an abrasive or abrading action on the tip of each workpiece as it moves over the abrasive surface to form a highly accurate and repeatable tip geometry, such as a chisel point, on each workpiece.

A feature of the sharpener apparatus in accordance with the invention lies in its use to resurface highly accurate and repeatable tips on electrodes which are used in pairs with an electrical circuit to create voltage discharge arcing between the tips when placed in predetermined relation to each other.

Further objects, advantages and features of the invention will become apparent from the following detailed description of a preferred embodiment when taken in conjunction with the accompanying drawing wherein like reference numerals designate like elements throughout the several views.

DETAILED DESCRIPTION OF THE DRAWING

DETAILED DESCRIPTION

Figure 1:
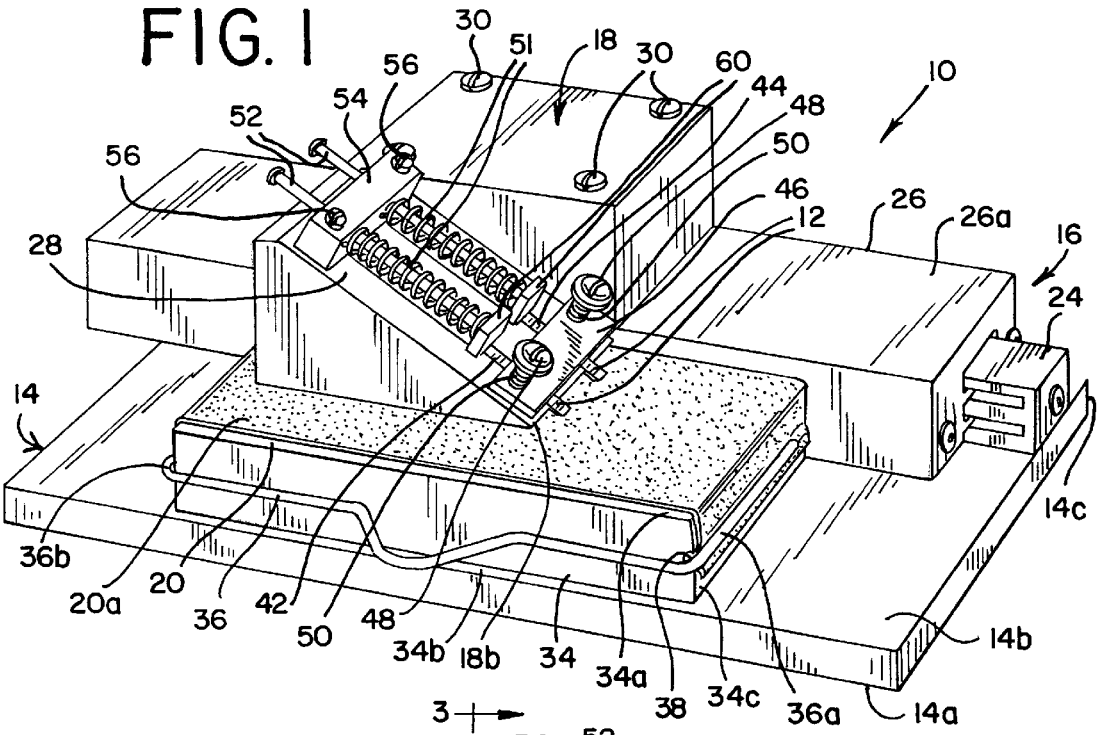
FIG. 1 is a perspective view of a sharpener apparatus constructed in accordance with the present invention.
Figure 2:
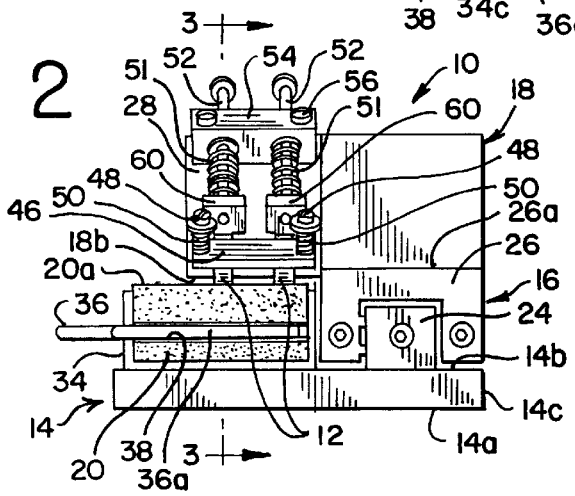
FIG. 2 is a front end elevational view of the sharpener apparatus illustrated in FIG. 1.

Referring now to the drawing, a sharpener apparatus constructed in accordance with a preferred embodiment of the present invention is indicated generally at 10. The sharpener apparatus 10 finds particular application in precise sharpening or resurfacing of the tips of workpieces in the form of elongated electrodes, two of which are indicated at 12, so as to provide a highly accurate and repeatable tip geometry on each workpiece. Very generally, the sharpener apparatus includes a base 14 on which is mounted a linear bearing assembly 16. A support block 18 is carried by the linear bearing assembly 16 for reciprocating rectilinear movement relative to the base. The support block 18 is operative to support at least one workpiece 12, and preferably a plurality of workpieces, with their lower tips in predetermined engagement with an upwardly facing substantially planar abrasive surface 20*a*. In the illustrated embodiment, the abrasive surface 20*a* is formed on a sheet 20 of abrasive material which is releasably supported in underlying relation to the workpiece-supporting portion of the support block 18 so that reciprocating movement of the support block effects an abrading action between the tips of the workpieces 12 and the abrasive surface 20*a* to form an accurate and repeatable tip geometry on each workpiece.

Turning now to a more detailed description of the various components of the sharpener device 10, the base 14 comprises a rectangular block having a planar lower surface 14*a* and an upper planar surface 14*b* parallel to the lower surface. The linear bearing assembly 16 comprises a commercially available linear bearing track of known design which includes an elongated rectilinear interior track member 24 of rectangular transverse cross-section. The track member 24 is fixed to the upper surface 14*b* of the base 14 spaced inwardly from and parallel to a lateral marginal edge 14*c* of the base. The linear bearing assembly also includes a slide member 26 that straddles the track member 24 and is interconnected thereto in a manner to allow free rectilinear reciprocating movement of the slide member along the track member between forward and rearward end positions, as is known. The slide member 26 has an upper planar surface 26*a* disposed parallel to the upper surface 14*b* of the base 14.

The support block 18 has a generally rectangular configuration except for an inclined surface 28. The support block 18 is mounted on the upper surface 26*a* of the slide member 26, as by screws 30, so as to extend in cantilever fashion transverse to the longitudinal axis of the slide member and in partially overlying upwardly spaced relation to the upper surface 14*b* of the base 14. The support block 18 is spaced sufficiently above the upper base surface 14*b* to accommodate a rectangular support plate 34 that is fixed on the upper surface 14*b* of base 14. The support plate 34 has parallel upper and lower precision planar surfaces 34*a* and 34*b* such that the upper surface 34*a* is parallel to the upper surface 26*a* of the linear bearing slide member 26 and spaced below the bottom planar surface 18*a* on the support block 18 sufficiently to provide a relatively close clearance, such as approximately 1/16 inch, between the abrasive surface 20*a* and the support block 18.

In the illustrated embodiment, the abrasive sheet 20 is releasably retained on the support plate 34 by a generally U-shaped retaining clip or wire 36. The retaining clip or wire 36 is preferably made of a suitable strength metallic wire of circular cross-section and has opposite parallel ends 36*a* and 36*b*. A groove 38 is formed in each transverse end surface 34*c* and 34*d* of the support plate 34 to receive and mate with the end portions 36*a* and 36*b* of retaining wire 36. The retaining wire 36 is configured so that with an abrasive sheet 20 placed on the upper surface 34*a* of the support plate 34 with opposite ends of the abrasive sheet folded downwardly over the end surfaces 34*c,d* of the support plate, an end 36*a* or 36*b* of the retaining wire 36 may be placed over one of the grooves 38 to capture and retain the corresponding end of the abrasive sheet. The opposite end 36*a* or 36*b* of retaining wire 36 is then pushed, either downwardly or in the plane of the retaining wire, to mate with the groove 38 in the opposite end surface of support block 34 and capture the opposite end of the abrasive sheet 20 within the corresponding end groove 38 to thereby hold the abrasive sheet tight against the upper planar surface 34*a* of support plate 34. It will be appreciated that the abrasive sheet 20 may be releasably retained on the support block 34 by other known techniques.

Figure 5:
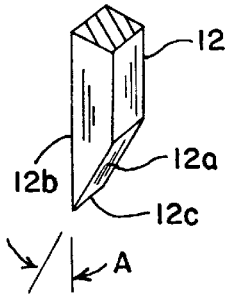
FIG. 5 is a fragmentary perspective view of the tip end of an electrode sharpened by the apparatus of FIG. 1.

Also in the illustrated embodiment, the support block 18 is adapted to support a pair of elongated workpieces 12 which are preferably substantially rectangular in transverse cross-section, such as a pair of elongated platinum electrodes of square cross-section, to facilitate forming or resurfacing of a precise tip geometry on each workpiece. As illustrated in FIG. 5, the tip geometry obtained by the illustrated embodiment of sharpener 10 is defined by an inclined planar surface 12*a* which intersects a sidewall surface 12*b* of the workpiece and forms a predetermined included angle "A" with surface 12*b*. This tip configuration may be referred as a chisel tip and has a relatively sharp edge 12*c* at its distal end. The workpieces 12 may constitute platinum electrodes for use in an apparatus wherein a pair of the electrodes are supported with their inclined surfaces 12*a* in predetermined parallel relation to each other so as to enable an electric voltage arcing or discharge between the parallel surfaces when the electrodes are connected in an appropriate electrical circuit, such as utilized in the aforementioned dielectric insulation material test as described in IEC Publication 112.

The inclined planar surface 28 on the rectangular support block 18 intersects a bottom corner edge 18*b* on the support block. The plane of surface 28 forms an included angle with the support block lower surface 18*a* that is substantially equal to the angle of incline "A" of the workpiece tip surface 12*a* relative to the workpiece sidewall surface 12*b*. A pair of identical open channels 42 and 44 are formed in the inclined surface 28 such that the channels have bottom inclined coplanar base surfaces lying in a plane parallel to the inclined surface 28. The channels 42 and 44 preferably extend the full length of inclined surface 28 and have side walls normal to their base surfaces spaced apart to receive the workpieces 12 in sliding relation and allow relatively free longitudinal movement of the workpieces in parallel planes perpendicular to the bottom surface 18*b* of support block 18. A rectangular hold-down plate 46 is supported on the inclined surface 28 by a pair of guide screws 48 so that plate 46 overlies the channels 42 and 44 and workpieces 12 when disposed within the channels. The plate 46 is urged against the inclined surface 28 by coil compression springs 50 disposed about the guide screws 48 between plate 46 and washers acting against the heads of the guide screws. The hold-down plate 46 enables the workpieces to slide longitudinally within the channels 42 and 44 but prevents the workpieces or electrodes from accidentally rising or lifting from the channels.

To bias the lower tip ends of the workpieces 12 against the abrasive surface 20*a*, a pair of identical constant force coil compression springs 51 are supported by the support block 18 so that each compression spring acts to apply a substantially constant longitudinal force on the corresponding one of the workpieces. Each of the coil compression springs 51 is supported coaxially about a guide rod 52 which is supported for longitudinal sliding movement by a rectangular support bar 54. The support bar 54 is mounted on the inclined surface 28 of the support block 18, as by screws 56, and has a pair of parallel cylindrical bores sized to receive the guide rods 52 in sliding relation with the longitudinal axes of the rods 52 parallel to the inclined surface 28 and lying in parallel vertical planes containing the longitudinal axes of the corresponding channels 42 and 44.

Figure 4:
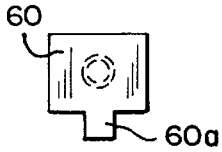
FIG. 4 is a,front elevational view, on an enlarged scale, of a pusher member as employed in the sharpener apparatus of FIGS. 1–3.
Figure 3:
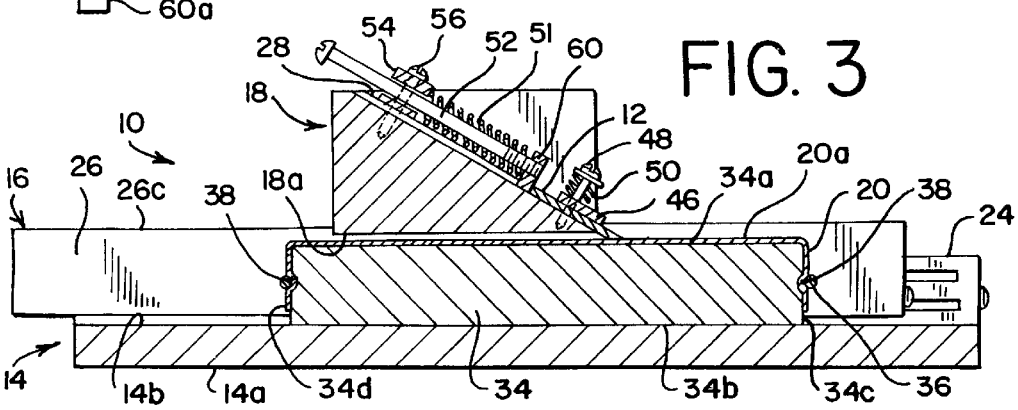
FIG. 3 is a longitudinal sectional view, on an enlarged scale, taken along line 3—3 of FIG. 2.

Each of the guide rods 52 has a pusher member 60 mounted on its lower end in transverse relation to the guide rod, as by a threaded connection between the pusher member and guide rod. As illustrated in FIG. 4, each pusher member 60 has a rectangular push-tab 60*a* formed thereon which is sized to extend into the corresponding channel 42 or 44. The pusher members 60 are adapted to be manually pushed upwardly along their corresponding channels 42 and 44 against the biasing force of the corresponding springs 51 so as to enable insertion of the workpieces 12 into the channels beneath the hold-down plate 46.

In operation, one or a pair of workpieces 12, such as elongated electrodes, are inserted into the channels 42 and 44 by lifting the hold-down plate 46 sufficiently to enable insertion. During insertion of the workpieces into the channels, generally one at a time, the corresponding pusher member 60 is forced upwardly against its spring 51 and then released so that the push-tab 60*a* engages the upper end of the workpiece to bias the lower tip end against the abrasive surface 20*a* of sheet 20 which has previously been mounted on the support plate 34. Thereafter, reciprocating movement of the support block 18 along the linear bearing assembly 16, either manually or by a powered reciprocating drive of known design (not shown), will form a planar inclined surface 12*a* and sharp tip edge 12*c* on each workpiece 12, or refinish the tip end if it has become eroded through use, as in the case of an electrode used to effect electric discharge arcing as aforedescribed. After sharpening or refinishing the tip ends of workpieces supported within the channels 42 and 44, the workpieces may be readily released from the channels by lifting the hold-down plate 46 or moving the support block 18 to a forward position enabling the workpieces to be longitudinally withdrawn from the channels.

It will be understood that while the abrasive surface 20*a* has been described as being formed on an abrasive sheet 20, the upper surface of the support plate 34 may have an abrasive surface formed directly thereon, or may have a recess formed therein to receive a conventional sharpening stone having a planar upper surface parallel to the lower surface of the support block 18. Similarly, if it is desired that the tips of the workpieces have a concave or contoured cutting edge, a suitably contoured abrasive surface can be utilized to form such a tip geometry. The various components of the sharpener apparatus 10 may be formed of metallic material or a suitable strength plastic or composite material.

Thus, while a preferred embodiment of a sharpener apparatus in accordance with the present invention has been illustrated and described, it will be understood to those skilled in the art that changes and modifications may be made therein without departing from the invention in its broader aspects. Various features of the invention are defined in the following claims.

What is claimed is:

1. A sharpener apparatus comprising, in combination, a base, a planar abrasive surface supported on said base, a carrier supported by said base and adapted for movement along a rectilinear path relative to said base, a support block supported by said carrier for movement therewith in overlying relation to said abrasive surface, said support block having a generally planar surface inclined at a predetermined angle to said abrasive surface and having at least one channel formed therein configured to receive a workpiece so as to enable longitudinal movement of the workpiece relative to said support block while preventing rotation of the workpiece about its longitudinal axis, said channel enabling a tip end of the workpiece to engage said abrasive surface, a guide rod supported by said support block in parallel relation to said channel, a constant force compression spring supported in generally coaxial relation on said guide rod for applying a longitudinal biasing force against the workpiece toward said abrasive surface so that its tip end engages the abrasive surface, and a pusher member fixed to an end of said guide rod and engaged by an end of said compression spring so as to apply said biasing force longitudinally of said workpiece and cause said tip to undergo abrasive sharpening when the support block is moved along said rectilinear path relative to said base.

2. A sharpener apparatus as defined in claim 1 wherein said carrier comprises a linear bearing assembly supported on said base, said support block being supported on said bearing assembly for rectilinear movement relative to said base.

3. A sharpener apparatus as defined in claim 1 wherein said inclined surface on said support block has a pair of channels formed therein in parallel relation so as to receive a pair of workpieces in longitudinally sliding relation, and including a constant force compression spring supported by said support block in parallel association with each of said channels, each of said compression springs being operative to apply a longitudinal force on a workpiece disposed within the corresponding channel to bias the tip of the workpiece against said abrasive surface.

4. A sharpener apparatus as defined in claim 1 including a spring biased hold-down plate supported by said support block to maintain the workpiece within said channel.

5. A sharpener apparatus as defined in claim 1 wherein said abrasive surface is formed on an abrasive sheet, and including a retaining clip for releasably retaining said abrasive sheet in relatively fixed relation to said base.

6. Apparatus for precision sharpening a tip end on a workpiece so as to form a planar end surface inclined at a predetermined angle to a longitudinal axis of the workpiece, said apparatus comprising, in combination, a base, abrasive means supported by said base for defining an abrasive surface, a support block overlying said abrasive surface and having a substantially planar surface thereon inclined at a predetermined angle to said planar abrasive surface said inclined surface, having at least one open channel therein for receiving a work-piece in sliding relation so that its longitudinal axis is inclined to said abrasive surface, guide means cooperative with said base and said support block for enabling rectilinear reciprocating movement of said support block relative to said abrasive surface, a guide rod supported by said support block in parallel relation to said channel, a constant force compression spring supported in generally coaxial relation on said guide rod, and a pusher member cooperative with an end of said guide rod and engaged by an end of said compression spring so as to apply a substantially constant biasing force longitudinal along said workpiece to bias the tip, end of the workpiece against the abrasive surface in substantially constant pressure engagement therewith.

7. Apparatus as defined in claim 6 wherein said guide means comprises a linear bearing assembly supported on said base, said support block being supported on said bearing assembly for rectilinear movement relative to said base.

8. Apparatus as defined in claim 6 wherein said inclined surface on said support block has a pair of channels formed therein in parallel relation so as to receive a pair of workpieces in longitudinally sliding relation, and including a constant force compression spring supported by said support block in parallel association with each of said channels, each of said compression springs being operative to apply a longitudinal biasing force on a workpiece disposed within the corresponding channel to bias the tip of the workpiece against said abrasive surface.

9. Apparatus as defined in claim 6 including a spring biased hold-down plate supported by said support block to maintain the workpiece within said channel.

* * * * *